United States Patent [19]

Blain

[11] Patent Number: 4,534,718

[45] Date of Patent: Aug. 13, 1985

[54] POSITIVE DISPLACEMENT SCROLL APPARATUS WITH BAND LINKING SCROLLS

[75] Inventor: Edward S. Blain, Rockford, Ill.

[73] Assignee: Sundstrand Corporation, Rockford, Ill.

[21] Appl. No.: 627,968

[22] Filed: Jul. 5, 1984

[51] Int. Cl.[3] ..... F01C 1/04; F01C 17/00

[52] U.S. Cl. ..... 418/55; 418/57

[58] Field of Search ..... 418/55–57

[56] References Cited

U.S. PATENT DOCUMENTS 3,600,114 8/1971 Dvorak et al. ..... 418/55

3,874,827 4/1975 Young ..... 418/55

4,371,323 2/1983 Fischer et al. ..... 418/55

*Primary Examiner*—John J. Vrablik

*Attorney, Agent, or Firm*—Wood, Dalton, Phillips, Mason & Rowe

[57] ABSTRACT

A positive displacement apparatus including first and second scrolls having interfitting vanes defining at least one fluid receiving moving pocket movable between an inlet and an outlet. The scrolls are mounted on parallel but offset axes by shafts such that one scroll orbits relative to the other. One of the shafts is driven by a motor and the scrolls are interconnected by a flexible band located peripherally of the scrolls for synchronization purposes.

10 Claims, 2 Drawing Figures

POSITIVE DISPLACEMENT SCROLL APPARATUS WITH BAND LINKING SCROLLS

FIELD OF THE INVENTION

This invention relates to positive displacement scroll apparatus of the type having two interfitting scrolls, and more particularly, to improved means for coupling the scrolls together to prevent substantial relative angular movement therebetween while allowing the necessary relative orbital movement between the scrolls which is required to achieve positive displacement of a fluid.

BACKGROUND OF THE INVENTION

Over the years there have been a number of proposals of positive displacement apparatus of the scroll type, frequently, but not always, for use as compressors in refrigeration systems. Such apparatus may also be utilized as expanders or in some instances as pumps. Though theoretically practical, scroll type apparatus has not been commercialized to any significant extent due to a variety of problems including sealing and wear.

As is well known, such apparatus include two scrolls with interfitting vanes. One scroll is made to orbit, but not rotate with respect to the other with the result that a traveling pocket between the vanes on the opposed scrolls is formed which moves from an inlet to an outlet. When the apparatus is used as a compressor, the configuration is such that the pocket becomes progressively smaller. Conversely, when used as an expander, the pocket becomes progressively larger. When used as a pump for incompressible fluids, the pocket will remain of constant size.

Generally speaking, such scroll apparatus have been of two types. In one type, one scroll is generally stationary while the other orbits with respect thereto. In another type, both scrolls rotate while in addition, the vanes on one of the scrolls orbit with respect to the vanes on the other. In some instances, combinations of both forms have been employed.

In any event, it is necessary that the vanes properly interfit and that there be proper movement and synchronism of one scroll relative to the other.

To achieve these goals, the prior art has generally resorted to highly precise component fabrication techniques and structure. For example, considerable pains are taken in forming the vanes on the scrolls so that they will properly interfit with each other during operation. In addition, numerous structures such as Oldham rings have been utilized to provide the desired synchronization. As a consequence, the expense of the units has been relatively high and the desired success has not yet been achieved because of high wear rates in the structure due to the high forces imposed in either type of system resulting from the fact that one scroll must move eccentrifically about an axis creating large bearing loads.

The present invention is directed to overcoming one or more of the above problems. Prior art of possible relevance with respect to the invention include the following U.S. Pat. Nos.: 3,874,827 issued Apr. 1, 1975 to Young and 4,371,323 issued Feb. 1, 1983 to Fischer et al.

SUMMARY OF THE INVENTION

It is a principal object of the invention to provide a new and improved positive displacement apparatus of the scroll type. More specifically, it is an object of the invention to provide such a positive displacement apparatus including inexpensive but positive acting means for assuring proper synchronization between scroll members.

An exemplary embodiment of the invention achieves the foregoing object in a positive displacement apparatus including first and second scrolls having interfitting vanes adapted to define at least one fluid receiving pocket movable between an inlet and an outlet. Means are provided for causing the vanes on one of the scrolls to move in an orbital path relative to the vanes on the other scroll such that the pocket moves between the inlet and the outlet. Means couple the scrolls together to prevent substantial relative angular movement therebetween while allowing the orbital movement and include a flexible band interconnecting the scrolls.

According to a preferred embodiment of the invention, the band surrounds the peripheries of the scrolls and is connected to each scroll at spaced points.

In a highly preferred embodiment, the band is of one piece construction in the form of a continuous hoop.

Advantageously, the band is rigid and inextensible axially of the scrolls so as to control the sealing clearance between the tips of the vanes.

The invention contemplates that the scrolls, at their peripheries, will have interfitting, alternating, generally arcuate band supports. The invention is applicable to either of the basic type of scroll apparatus, mainly, the stationary scroll—orbiting scroll type or a rotating scroll—rotating and orbiting scroll type.

Other objects and advantages will become apparent from the following specification taken in connection with the accompanying drawings.

DESCRIPTION OF THE PREFERRED EMBODIMENT

Figure 1:
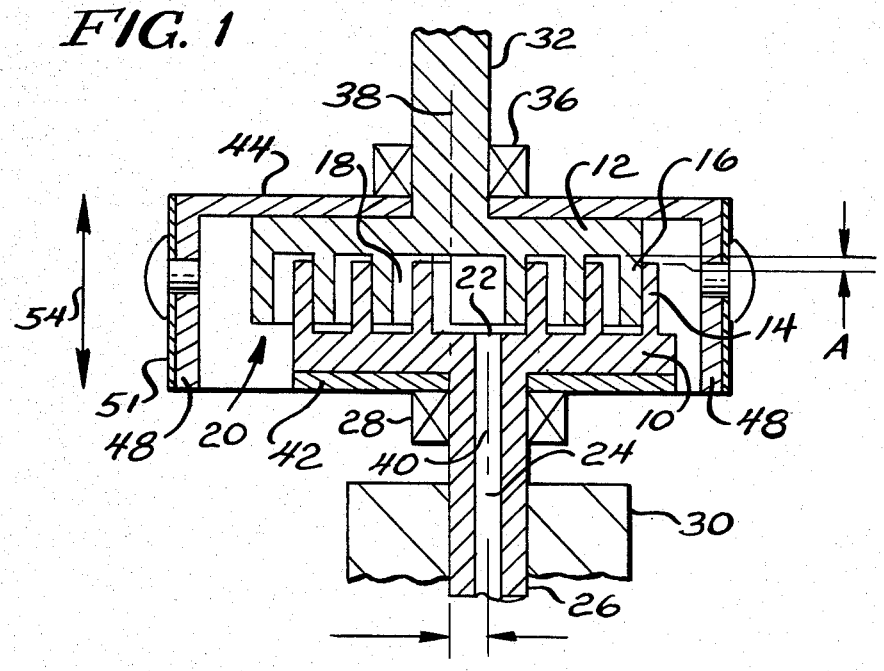
FIG. 1 is a sectional view of a positive displacement scroll apparatus made according to the invention.

An exemplary embodiment of a positive displacement scroll apparatus made according to the invention is illustrated in the drawings and with reference to FIG. 1 is seen to include a driving scroll 10 and a driven scroll 12. The scrolls 10 and 12 have axially directed vanes 14 and 16, respectively, which may be configured in a conventional fashion and which interfit to define at least one pocket 18. The pocket 18 is movable between an inlet and an outlet and carries fluid between the same. For the apparatus illustrated in FIG. 1, wherein a compressor is shown, the inlet may be an area, generally designated 20, adjacent the periphery of the scrolls 10 and 12 while the outlet is in the form of central port 22 at one end of the hollow 24 of a shaft 26 mounting the scroll 10.

Bearings 28 mount the shaft 26 for rotation and a motor 30 is utilized to drive the same to thereby rotate the scroll 10.

The specific apparatus shown in FIG. 1 is of the type wherein both scrolls 10 and 12 rotate and to this end, the scroll 12 is also connected to a shaft 32 journalled for rotation by suitable bearings 36. The axis of the shaft 32 is shown at 38 whereas the axis of the shaft 26 is shown at 40. It will be observed that the two are parallel but offset. As a consequence, when both scrolls 10 and 12 are rotated in the same direction, the vanes on one will orbit with respect to the other to cause movement of the pocket 18 as mentioned previously.

As is well known, it is necessary to maintain the scrolls 10 and 12 in a desired angular relationship with respect to each other whether both scrolls are rotating as in the type of apparatus illustrated in the drawings or where one is stationary and the other is merely orbiting. To this end, the invention provides a unique coupling between the scrolls 10 and 12. In particular, a plate 42 is secured to the side of the scroll 10 opposite the vanes 14 while a similar plate 44 is secured to the scroll 12 oppositely of the vanes 16. The securement may be by any conventional means, including by welding.

Figure 2:
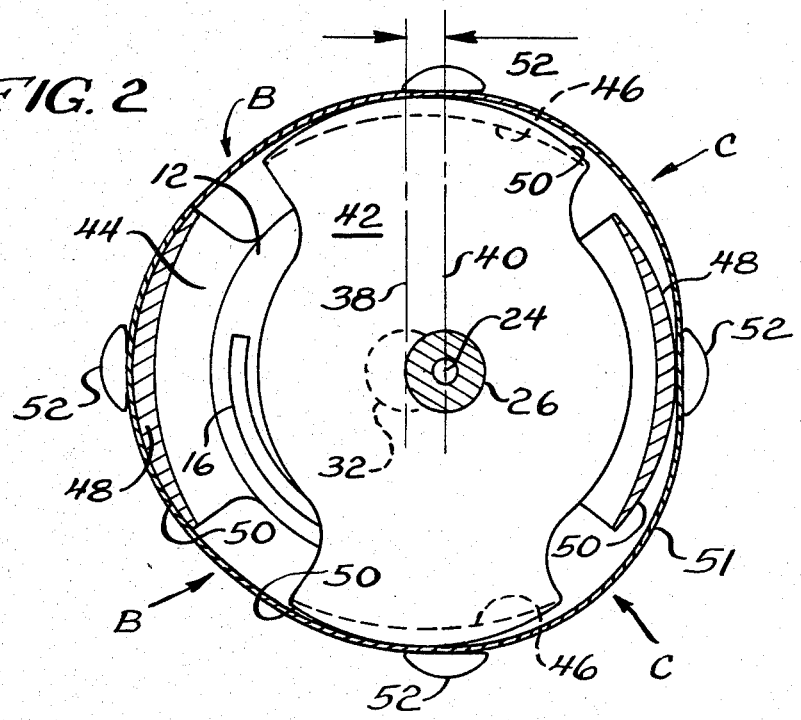
FIG. 2 is a bottom plan view of the apparatus with parts shown in section.

The plates 42 and 44 extend generally radially of the associated shafts 26 and 32 to a location radially outwardly of the associated vanes 14 or 16. At this location, at opposite ends of each of the plates 42 and 44, there are axially directed band supports. The band supports mounted on the plate 42 are shown in dotted form and designated 46 in FIG. 2 while those mounted on the plate 44 are shown at 48. In either case, the same have a generally crescent-shaped cross section as illustrated in FIG. 2 and have radially outwardly facing arcuate surfaces 50. The surfaces 50 have a radius approximately equal to the radius to the associated axis 38 or 40.

A band 51 of flexible material is disposed in surrounding relationship to the surfaces 50 and secured thereto as by rivets 52 centrally of each surface 50. The band 51 may be formed of any suitable material including metal or one or more plies of metal and/or wraps of fibrous material or the like. Preferably, the band is in the form of a continuous hoop as illustrated in FIG. 2 but the same could be made up of a plurality of individual parts as, for example, parts extending between each of the rivets 52 or any other securing form that might be employed.

A preferred characteristic of the band 51 is that it be rigid or generally inextensible in the axial direction as indicated by an arrow 54 shown in FIG. 1. As seen in FIG. 1, a dimension shown at A represents the so-called "tip clearance" which is the distance between the top of the vane 14 or the vane 16 and the base of the scrolls 12 or 10, respectively. This dimension, which is desirably controlled in scroll compressors as is well known, can be controlled simply by providing axial stiffness and/or inextensibility of the band 51 in the axial direction.

During operation of the apparatus, at various points, the band 51 will assume configurations as are shown in FIG. 2. For example, at points shown at B in FIG. 2, the band will be flexed inwardly and supported by the band supports 48 and 50. At points designated C, the band 51 will be flexed outwardly but restrained by one of the rivets 52. If desired, radially outer support surfaces can be added to accommodate this condition.

In any event, rotation of the shaft 26 will of course rotate the scroll 10 and the associated plate 42 and ultimately the band 51. This rotative motion will be imparted to the scroll 12 via the plate 44 and because of the inextensible nature of the band, it will be appreciated that both scrolls 10 and 12 will rotate in substantial synchronism. The flexibility of the band allows the requisite orbital movement to occur. An important feature of the invention is the fact that the flexible nature of the band does permit slight angular position shifts of the scroll elements relative to each other. This can be of significant value where the device is operating as a positive displacement pump or compressor and incompressible fluids as, for example, lubricating oil in a gas, fill or substantially fill the pocket 18 at some point in its path of movement. This relative, but slight, angular shift permits the scrolls to unwind allowing the condition to be relieved by a change in seal clearance around the flanks of the vanes 14 and 16.

Thus, the invention provides an inexpensive means for assuring desired synchronization between the scroll elements in a positive displacement scroll apparatus. The same will be appreciated as being useful in both stationary—orbiting scroll systems and in rotating—rotating and orbiting scroll systems. Where desired, flexibility and extensibility of the band can be suitably chosen to achieve any desired degree of flex capability for unloading the scrolls in the case of the encountering of obstructions or overloads.

I claim:

1. A positive displacement apparatus comprising:
first and second scrolls having interfitting vanes adapted to define at least one fluid receiving pocket movable between an inlet and an outlet;
means for causing the vane on one of said scrolls to move in an orbital path relative to the vane on the other scroll such that said pocket moves between said inlet and outlet; and
means coupling said scrolls together to prevent substantial relative angular movement therebetween allowing said orbital movement including a flexible, ring-like band interconnecting said scrolls.

2. A positive displacement apparatus comprising:
first and second scrolls having interfitting vanes adapted to define at least one fluid receiving pocket movable between an inlet and an outlet;
means for causing the vane on one of said scrolls to move in an orbital path relative to the vane on the other scroll such that said pocket moves between said inlet and outlet; and
means coupling said scrolls together to prevent substantial relative angular movement therebetween allowing said orbital movement including a flexible band interconnecting said scrolls, said band surrounding the peripheries of said scrolls and being connected to each at spaced points.

3. The positive displacement apparatus of claim 2 wherein said band is of one-piece construction.

4. The positive displacement apparatus of claim 2 wherein said band is rigid axially of said scrolls.

5. The positive displacement apparatus of claim 2 wherein said scrolls, at their peripheries having interfitting, alternating, generally arcuate band supports defining said spaced points.

6. A positive displacement apparatus comprising:
first and second scrolls having interfitting vanes adapted to define at least one fluid receiving pocket movable between an inlet and an outlet;
first and second shafts respectively mounting said first and second scrolls;
means journalling said shafts for rotation about offset, parallel aces;
means for rotating one of said shafts and the corresponding scroll; and
a flexible band located peripherally of said scrolls and attached to said scrolls at spaced points for imparting rotation to the other scroll while preventing substantial relative angular movement between said scrolls.

7. The positive displacement apparatus of claim 6 wherein said band is a continuous hoop.

8. A positive displacement apparatus comprising:

first and second scrolls having interfitting vanes adapted to define at least one fluid receiving pocket movable between an inlet and an outlet;

means for causing the vane on one of said scrolls to move in an orbital path relative to the vane on the other scroll such that said pocket moves between said inlet and outlet; and at least two opposed, radially outwardly facing, generally arcuate surfaces on each of said scrolls radially outwardly of the vane thereon, the arcuate surfaces on one of said scrolls being angularly staggered with respect to the arcuate surfaces on the other of said scrolls and generally axially aligned; and flexible band means interconnecting said surfaces.

9. The positive displacement apparatus of claim 8 wherein said flexible band means is rigidly secured to each of said surfaces intermediate the ends thereof and is generally inextensible and rigid axially of said scrolls to control clearance between the vane on one scroll and the other scroll and vice versa.

10. The positive displacement apparatus of claim 9 wherein said band means comprises a continuous hoop which is secured to said surfaces by rivets.

* * * * *